US005891526A

United States Patent [19]

Brady et al.

[11] Patent Number: 5,891,526

[45] Date of Patent: Apr. 6, 1999

[54] APPARATUS FOR MIXING A MULTI-COMPONENT ENCAPSULANT AND INJECTING IT THROUGH A HEATED NOZZLE ONTO A PART TO BE ENCAPSULATED

[75] Inventors: Michael John Brady, Brewster; Stephen Leslie Buchwalter, Hopewell Junction; David Andrew Lewis, Carmel, all of N.Y.

[73] Assignee: International Business Machines Corporation, Armonk, N.Y.

[21] Appl. No.: 929,477

[22] Filed: Sep. 15, 1997

Related U.S. Application Data

[63] Continuation of Ser. No. 615,913, Mar. 14, 1996.

[60] Provisional application No. 60/007,837 Dec. 1, 1995.

[51] Int. Cl.[6] ..... B05D 1/02; B05D 3/02

[52] U.S. Cl. ..... 427/422; 427/314; 427/385.5; 427/386; 427/424; 118/302

[58] Field of Search ..... 427/422, 424, 427/358, 350, 79, 101, 314, 385.5, 386; 118/410, 302; 239/13, 135, 433, 427

[56] References Cited

U.S. PATENT DOCUMENTS

| | | | |
|---|---|---|---|
| 1,060,043 | 4/1913 | Walker . | |
| 2,660,190 | 11/1953 | Blondel . | |
| 3,218,040 | 11/1965 | Richter . | |
| 3,347,529 | 10/1967 | Hoppe et al. . | |
| 3,394,441 | 7/1968 | Weiss | 29/25.42 |
| 3,690,297 | 9/1972 | Dentch et al. | 118/410 |
| 3,831,907 | 8/1974 | Claes | 259/7 |
| 3,836,388 | 9/1974 | Fowler | 117/120 |
| 3,921,901 | 11/1975 | Woodman | 239/13 |
| 4,038,442 | 7/1977 | Utumi | 427/128 |
| 4,246,335 | 1/1981 | Keogh et al. | 430/278 |
| 4,279,964 | 7/1981 | Heller | 428/496 |
| 4,289,733 | 9/1981 | Saito et al. . | |
| 4,438,074 | 3/1984 | Wilt . | |
| 4,568,192 | 2/1986 | Kudermann et al. . | |
| 4,636,085 | 1/1987 | Kopernicky . | |
| 4,678,881 | 7/1987 | Griffith . | |
| 4,741,623 | 5/1988 | Haeuser et al. . | |
| 4,834,545 | 5/1989 | Inoue et al. . | |
| 4,871,579 | 10/1989 | Bravet et al. | 427/31 |
| 4,922,852 | 5/1990 | Price | 118/683 |
| 4,961,965 | 10/1990 | Dietz | 427/286 |
| 5,058,805 | 10/1991 | Anderson et al. | 239/3 |
| 5,171,089 | 12/1992 | Kuo et al. | 366/146 |
| 5,284,275 | 2/1994 | Shomer . | |
| 5,314,506 | 5/1994 | Midler, Jr. et al. . | |
| 5,403,088 | 4/1995 | Killmer et al. . | |

FOREIGN PATENT DOCUMENTS

| | | |
|---|---|---|
| 54-125254 | 3/1978 | Japan . |

*Primary Examiner*—Shrive Beck
*Assistant Examiner*—Michael Barr
*Attorney, Agent, or Firm*—Ronald L. Drumheller; Daniel P. Morris

[57] ABSTRACT

The present invention is an apparatus and method for mixing a plurality of materials in-situ to form an admixture and heating a localized portion of admixture upon dispense. The heat thereby primarily effects the speed of chemical reaction and curing of only the exiting reactants with little effect upon the admixture not dispensed. The apparatus and process are especially useful for encapsulating a plurality of workpieces at a high throughput. Advantageous configurations are described such as wherein the workpieces and/or the dispensing mechanism may be mounted on a carrier and fed by an assembly line. Alternative admixture chemistries are described.

5 Claims, 4 Drawing Sheets

APPARATUS FOR MIXING A MULTI-COMPONENT ENCAPSULANT AND INJECTING IT THROUGH A HEATED NOZZLE ONTO A PART TO BE ENCAPSULATED

This is a continuation of application Ser. No. 08/615,913, filed Mar. 14, 1996.

This application claims priority from Provisional Application Serial No. 60/007,837 which was filed Dec. 1, 1995.

FIELD OF THE INVENTION

The present invention is directed to an apparatus and method for in-situ mixing, heating and dispensing of materials. More particularly, it is also directed to the application of a heated mixture to devices on an assembly line.

BACKGROUND OF THE INVENTION

It is a constant endeavor to find improved ways to apply resins to encapsulate components, chips and/or modules. Presently chip or glob top encapsulation is generally accomplished with premixed materials. Pitfalls associated with this method range from improper resin storage, difficulty of flow control, and improper tube or syringe properties for application requirements. In order to extend the mixture's shelf life, it has to be frozen and subsequently thawed for use. It is absolutely essential to maintain the mixture at its required temperature. Failure to maintain proper storage temperature causes accelerated aging. This often results in increased material viscosity requiring ejection at a high pressure.

Most encapsulation methods presently employed require long cure cycles. A long cure cycle is particularly costly and inappropriate for use in an automated assembly line for a high volume throughput. This is evident by considering a typical assembly line situation. An assembly line with a line speed of 12 feet/min, and a cure time at raised temperature of 10 minutes, requires an oven at least 120 feet long. Currently, proper curing of a one pot, premixed encapsulation material takes about two hours at a raised temperature. To partially overcome this problem for devices mounted on a continuous tape-like strip, the parts are rolled after the encapsulating material, the encapsulant, has gelled. This is to prevent the parts from flowing, peeling or sticking to each other. In addition, the parts have to be cut and placed in a cassette for post curing.

Successful use of a one pot reactant material mixture in a large volume encapsulation application is difficult. In any one pot mixture, a reaction is progressing at all times. Increasing the temperature of the reacting system accelerates the reaction, while cooling slows the reaction. The actual change in the reaction rate is dependent on the viscosity. Intrinsically it depends upon the activation energy for the reaction. The reaction rate approximate doubles with every 10° Centigrade increase in temperature. The use of very high temperatures to force a reaction to proceed extremely quickly is limited by the thermal stability of the reactants and products of the reaction. For aliphatic containing epoxy resins, this temperature is limited to about 170° C. Aromatic epoxy resins can sustain substantially higher temperatures, but the reactivity of these species is substantially slower than for aliphatic systems and some reaction chemistries are not suitable for aromatic based resins.

One solution is to include a very efficient and fast catalyst system in the filled epoxy resin used for chip encapsulation. Shelf life becomes a very significant problem if the catalyst is very fast. Methods and devices to mix two liquids with and without the simultaneous application of thermal energy exist. Unfortunately, none can be successfully used in an application requiring very fast reaction. The problem of uniform heating throughout the mixing chamber was addressed by Griffith, U.S. Pat. No. 4,678,881, by using a heated paddle. The present invention presents a solution in which the catalyst is mixed with the resin only immediately prior to its being dispensed to encapsulate a device.

Inoue, U.S. Pat. No. 4,834,545, addresses the problem of mixing and dispensing an admixture of two materials by utilizing a conical mixing chamber and axial motion of the mixing spindle to eject the resin. There is no provision for heating. If the entire chamber was heated, residual resin in the mixing chamber following ejection would cure and result in buildup and eventually clogging and poor dispense column control.

Continuous reactors, such as that presented by Wilt, U.S. Pat. No. 4,438,074, typically have very long residence times with temperature control. There is no means of dispensing controlled amounts of the product and certainly no means for heating the mixture after dispense. These systems are typically used in mixtures which include a solvent. The resultant lower viscosity mixture does not require large shearing forces to be dispensed from the mixer. Materials requiring relatively large shearing forces preclude many means for dispensing the resin. The present invention is applicable even to filled materials which generally may require large shearing forces to be dispensed.

Haeuser, U.S. Pat. No. 4,741,623, shows a means for pumping a liquid into a mixing chamber, but gives no indication as to how the reactants are mixed or dispensed from the mixing chamber or subsequently heated.

Japanese patent, JP7833275, describes the mixing of two reactants and injection into a mold. This patent does not concern itself with controlled dispense or heating the reactants upon exit. The present invention used in conjunction with the device described in this patent would result in the resin curing within the mixing chamber and clogging it.

It is an object of the present invention to provide a means that can satisfactorily deliver a controlled volume of fast curing resin in a very precise and consistent manner around a device. This would eliminate the need for very long and expensive tunnel ovens in assembly line applications. It is another object to use epoxy resins that are highly filled to attempt to better match the coefficients of thermal expansion (CTE) of the resin and the chip. A very heavy loading of greater than 50 volume percent decreases the mixture's CTE to about 30 ppm as compared to about 60–80 ppm for the neat resin. The chip's CTE is about 2 ppm. The CTE of the lead frame on which the chip is mounted is about 18–25 ppm. By reducing the CTE mismatch, residual stress is reduced in the resulting structure.

It is another object of the present invention to reduce the resin's viscosity by heating it prior to its being applied to the chip. This allows the resin to settle around the chip and to effectively encapsulate the chip without leaving substantial voids or bubbles. It also reduces the time necessary to reheat the resin on the chip thereby reducing the necessary curing time. It enables the reaction to start prior to deposition on the chip. This is advantageous since viscosity increases very slowly in the initial stages of a reaction. The rate of increase of the viscosity increases with the extent of reaction until the gel point is reached. At this point the viscosity is essentially infinite. Prior heating also helps the small amount of resin to drop properly from the tip of the applicator. Proper resin dropping is related to surface tension and viscosity which decrease with temperature.

If the mixer or the stirrer in the mixer is heated in entirety, the chemistry starts prematurely. Premature heating would cause the formation of surface coatings even if the resin is flushed out of the mixer often. The coatings gel and become permanent within the mixer. Ultimately, the thickness of this coating becomes sufficient to contaminate the mixer. This would require that the mixer be disassembled and cleaned or replaced.

The present invention overcomes these problems and provides a method and apparatus which may be employed in extremely high volume throughput applications. The encapsulating material is mixed in-situ which leads to a shortened cure time in the order of several minutes or less, for example five minutes. This process also provides improved and increased processing capability and longer material pot life.

SUMMARY OF THE INVENTION

The present invention is directed to in-situ mixing and dispensing of materials. It is specifically directed to the local application of heat to the dispensing portion of a reactant admixture simultaneous with the dispensing so as to speed up the curing of the dispensed materials without effecting the materials not dispensed. It is still more specifically directed to the application of the heated dispensed admixture to components on an assembly line. It is desirable that the components being encapsulated are preheated.

A broad aspect of the present invention is an apparatus having a mixing chamber which includes means for receiving and mixing materials to form a combination substance. It also includes means for dispensing the combination substance from an output port onto a workpiece, and means for raising the temperature of the dispensed combination substance in correspondence with the means for dispensing. Generally, the combination substance includes a reactive curable mixture of polymers. It is desirable for the dispensing means to include means for controlling the amount of combination substance dispensed, means for controlling the position, time and duration for the dispensing to occur, means to dispense a drop, or an elongated or otherwise shaped quantity of the combination substance, and means for positioning each workpiece at a position to receive the combination substance being dispensed. Desirable means for raising the temperature includes RF induction heating and resistive heating.

Another aspect of the present invention includes an assembly line means for carrying and moving each workpiece to a position to receive the combination substance and/or for moving the dispensing apparatus to the position of each device receiving the combination substance.

Still another aspect of the present invention is an apparatus for controllably dispensing on a workpiece a curable material which is at least partially cured. The apparatus includes a container for the material, means for controlling an amount of material dispensed through a dispensing port and means for at least partially curing the material as the material is dispensed onto the workpiece.

Another broad aspect of the present invention is a method for controllably dispensing on a workpiece a curable material which is at least partially cured. The method includes the step of controllably ejecting the curable material towards the workpiece while controllably curing the curable material so that the workpiece receives the curable material at a predetermined degree of cure.

Another method of the present invention is a process for dispensing a combination substance formed from a plurality of materials. The method includes the steps of mixing and dispensing the substance and raising the temperature of the substance in correspondence with its being dispensed. It is desirable that the method also include the steps of providing workpieces and applying the substance dispensed onto each of the workpieces especially when the substance is for encapsulating each workpiece.

Another aspect of the present invention is a method which includes steps of sequentially feeding the workpieces to receive the substance and controlling the type, amount, position, time and duration of dispense. This is desirably performed using an assembly line means and having the workpieces mounted on a reel.

BRIEF DESCRIPTION OF THE DRAWINGS

These and other objects, features, and advantages of the present invention will become apparent upon further consideration of the following detailed description of the invention when read in conjunction with the drawing figures, in which.

DETAILED DESCRIPTION OF THE INVENTION

The present invention is an apparatus and process for encapsulating a workpiece with a material formed by mixing a resin and a catalyst in-situ. The components are fed into a mixing chamber in controlled volumes wherein they are intimately mixed. The admixture is fed into a connecting chamber which contains a delivery device to accurately and consistently deliver a controlled volume of admixture. According to the present invention only a small portion of the admixture is heated immediately prior to, upon exiting, or during delivery from the delivery device. It is advantageous to also preheat the workpiece being encapsulated to reduce moisture absorption and enhance adhesion. Minimally, the resin should cure beyond the gel point, but ideally, it should cure completely. At the gel point the resin has essentially infinite viscosity and cannot flow or creep. It is desirably accomplished within the time it takes to accumulate the resulting encapsulated workpieces by rolling or placing them in a cassette. This results in the encapsulation of the workpiece with a controlled volume of resin in a reduced cure time, thereby, making the process applicable to extremely high throughput assembly line requirements. Although the process is described for mixing two components, it is applicable to the mixing of three or more components.

Figure 1:
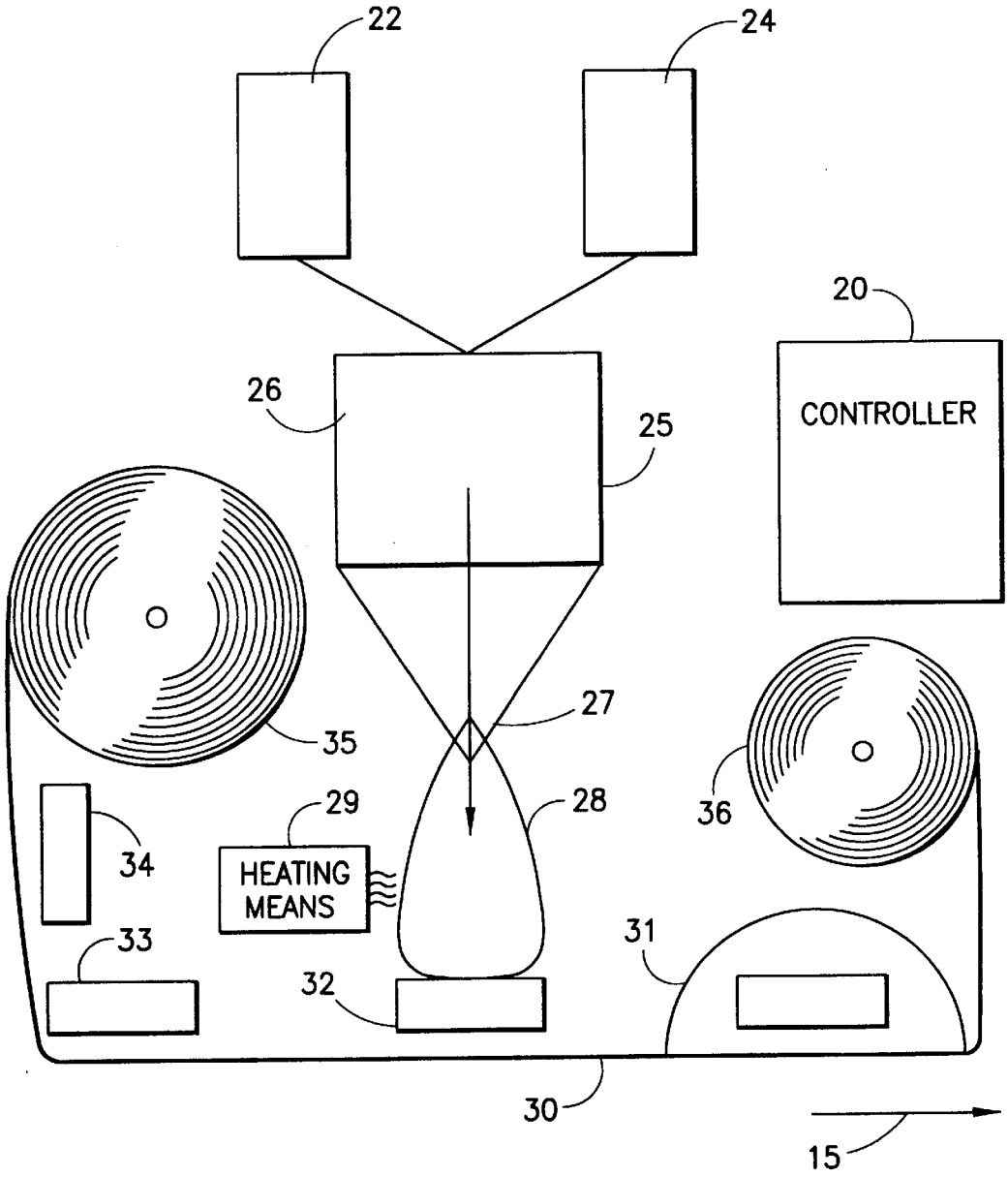
FIG. 1 shows a schematic diagram of an apparatus of the present invention.

The process and apparatus are schematically shown in FIG. 1, in which two reactants are stored in and delivered from reservoirs 22 and 24 to a mixing device 25. The mixing device 25 mixes the reactants from reservoirs 22 and 24 and dispenses the admixture 26 of the reactants. A drop 28 of the admixture 26 is heated upon exit from dispense port 27 and dropped onto a moving conveyor 30 carrying the workpieces 31–34 to be encapsulated. It is preferable to have the workpieces mounted on a tape reel for feeding 35 and a tape reel for uptake 36. Workpiece 31 is shown to be encapsulated after having already passed the dispense port 27. Workpiece 32 is being encapsulated. Workpieces 33–34 are to be encapsulated. The process is controlled by a controller 20 which overseas the operation and controls the time of dispensing drop 28 to correspond with the passing of a workpiece to be encapsulated under the dispense port 27. A heating means 29 is provided for raising the temperature of drop 28. Due to the fast chemical reaction of the heated drop 28, the time for curing the encapsulated workpiece 31 is very short. It is desirable that the dispensing apparatus and heating mechanism work cooperatively in such a way as to isolate the heat generated from the major portion of substance not being ejected.

Figure 2:
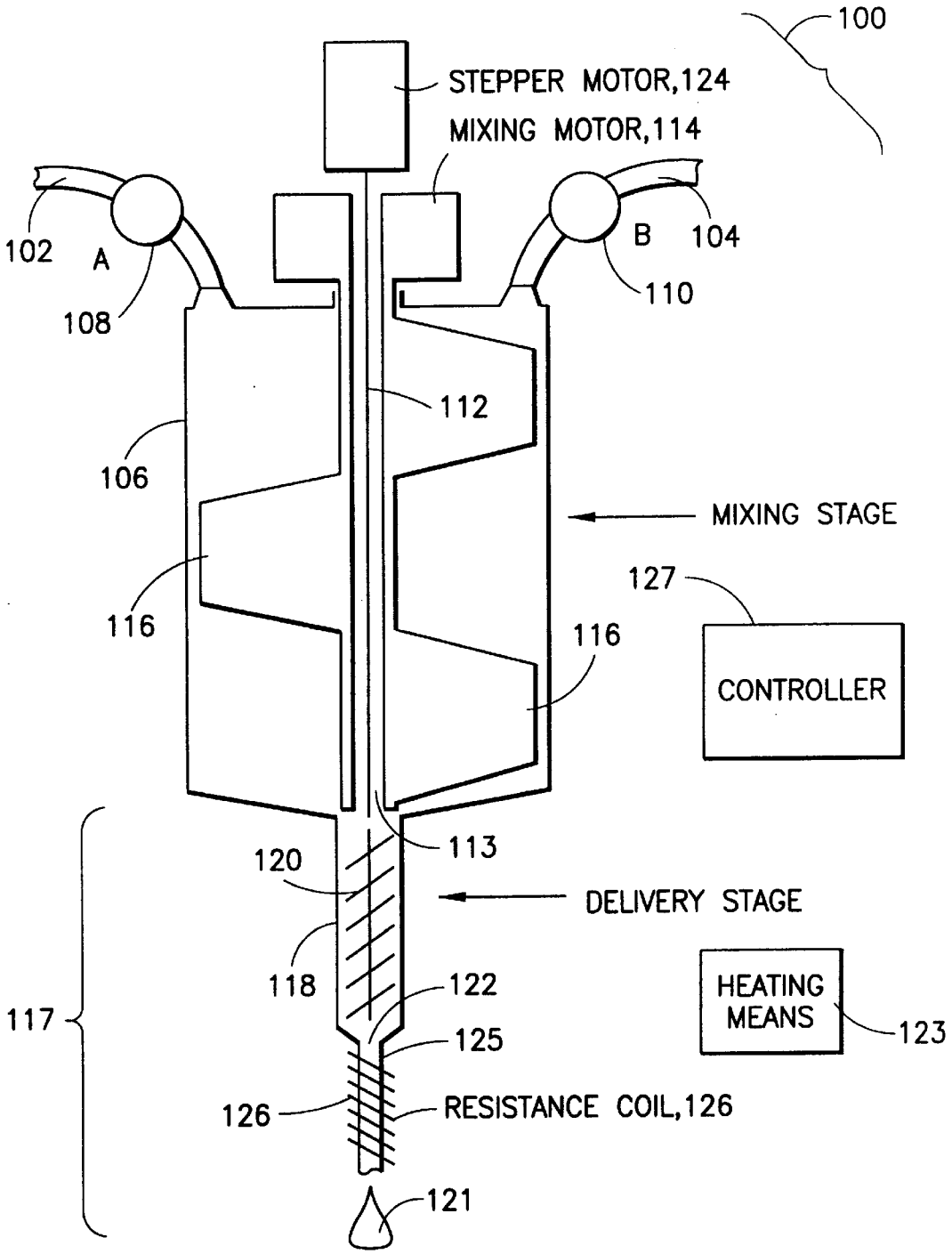
FIG. 2 shows a schematic diagram of the apparatus of FIG. 1 with more detail.

A more detailed embodiment of a method and apparatus practicing the present invention is illustrated in FIG. 2. FIG. 2 shows a mixing system structure 100 in which the input streams of two components 102 and 104 enter a mixing chamber 106 through flow controllers 108 and 110. The flow can also be controlled using a linear pump at the source of each of the components to be mixed. This would eliminate the need for flow controllers 108 and 110. It is desirable that the pressure of the components 102 and 104 be the same as the pressure in the mixing chamber 106. The components 102 and 104 are intimately mixed using a stirrer 112 which has a hollow shaft 113 and is connected to a high torque mixing motor 114. Desirably, the mixing motor 114 moves at a substantially constant, predefined speed in a particular direction. The paddles 116 on the mixing system are designed to exert a pressure in the downward direction towards the dispense head 117. The dispense head 117 includes a delivery stage 118 and a heating means 123. The delivery stage 118 is adjacent and connected to the mixing chamber 106. The delivery stage 118 contains a screw extruder 120 which when turned in a specific direction forces the contents 119 of the delivery stage 118 through an orifice 122. The orifice 122 is preferably such as to form a desired shape, width and elongation of the dispensing substance. The screw extruder 120 is controlled by a precision motor 124 through the hollow center shaft of the stirrer 112. It is preferably employed to control the amount of the substance being dispensed and/or the duration of the dispense. In some cases the amount may be as little as 0.1 to 1 ml. When turned in the opposite direction, the screw extruder 120 causes material remaining in the delivery chamber to be sucked back into the mixing chamber. The extruder motor 124 is preferably a stepping motor. When a droplet or other shape of material is required, the structure controller 120 issues a signal to turn the screw extruder in proportion to the volume of the droplet required. The droplet 121 is heated by a heating means 123 which tends to localize the region of resin temperature increase to the droplet. Depending upon the heating method employed, the droplet 121 is heated just prior to its being dispensed, coincident with its being dispensed and/or immediately after its being dispensed from the orifice 122. It is desirable that the dispensing apparatus and heating means 123 work cooperatively in such a way as to isolate the heat generated away from the major portion of substance not being ejected.

One means for accomplishing this localized heating is the use of RF induction heating. In this technique, the heating element 126 is a coiled wire through which RF radiation is passed. Use of a tip 125 to support the heating element 126 is optional. This creates an alternating electric field within the region of the coil and slightly beyond, along the center axis of the coil. RF radiation couples energy to the resin drop 122 passing through it by a variety of mechanisms, including dipolar relaxation, ionic conductivity or resistive heating of conductive elements. The preferred admixture material for this application contains carbon black as a filler and coloring agent. Carbon black is partially conductive, resulting in rapid heating in an RF field. Desirably, the RF radiation is controlled by the controller 120 and is only turned on when resin is passing through the orifice 122.

Another means for heating the resin on exit is to use resistive heaters as the heating element 126 along a tip 125. In this case, a screw extruder 120 is turned to force a desired amount of resin, drop 121, through orifice 122 and out the heated region. Following dispense of the drop 121, the extruder motor 124 is set to perform a reverse turn to remove any excess material in the heated region in a very short amount of time. This is to prevent premature chemical reaction of the excess admixture. When the next drop of admixture is due, the extruder motor 124 drives to account for the material pulled back from the previous drop in addition to the volume required for the next drop. Other methods of providing thermal energy to the dispensing substance may be used.

In the means described the mixing structure is stationary and the workpieces to be encapsulated are moved along an assembly line. The inventive process is similarly applicable to a moving mixing structure. Thus, in another embodiment of the present invention, rather than the workpieces to be encapsulated moving on a conveyor, the mixing structure can be placed above an X-Y-Z table on which the workpieces to be encapsulated are placed, or the mixing structure is itself movable.

Figure 3:
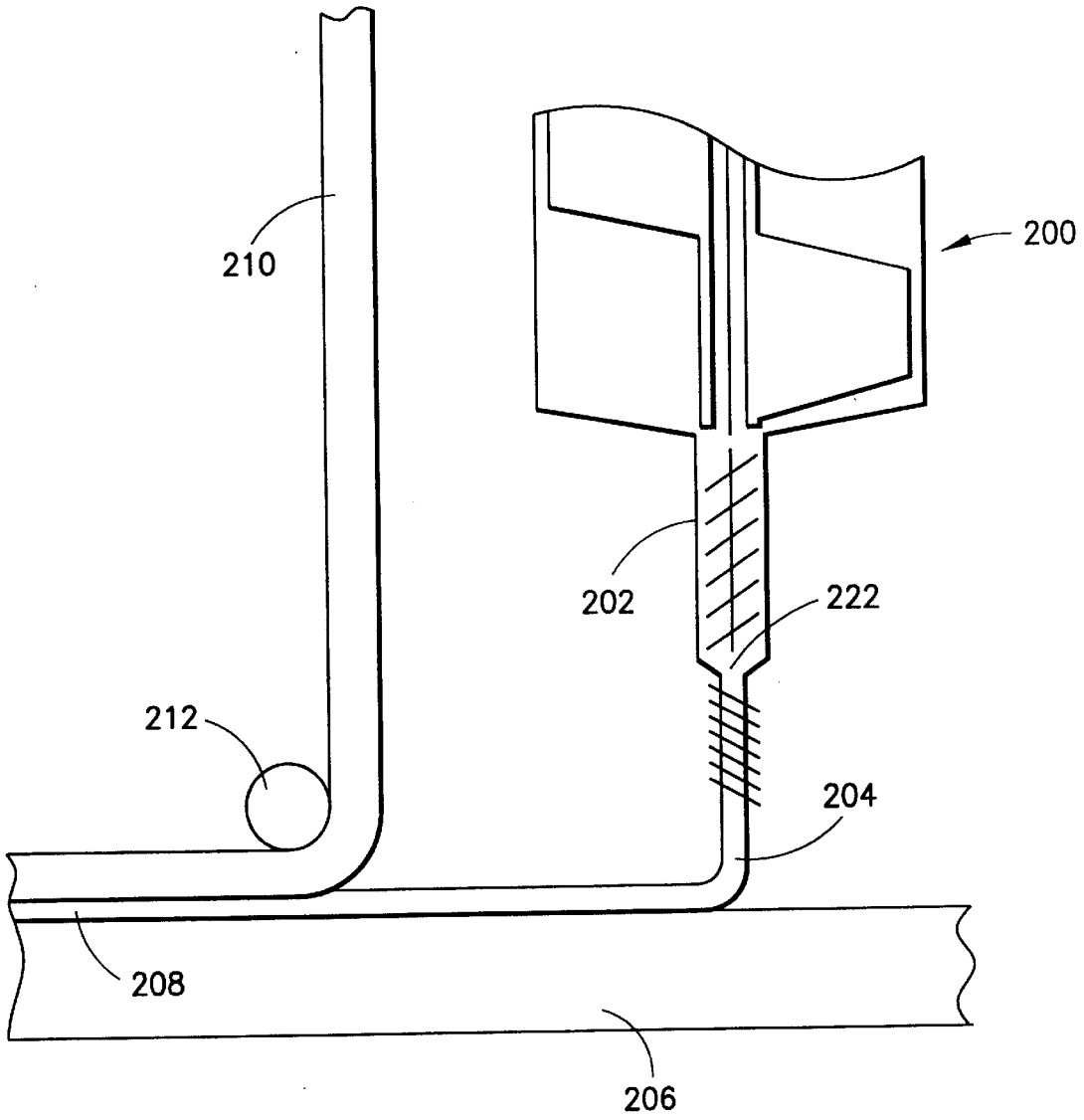
FIG. 3 shows an enlargement of the ejection end of the apparatus of FIG. 2 with an elongated ejected curable material being disposed on a work piece.
Figure 4:
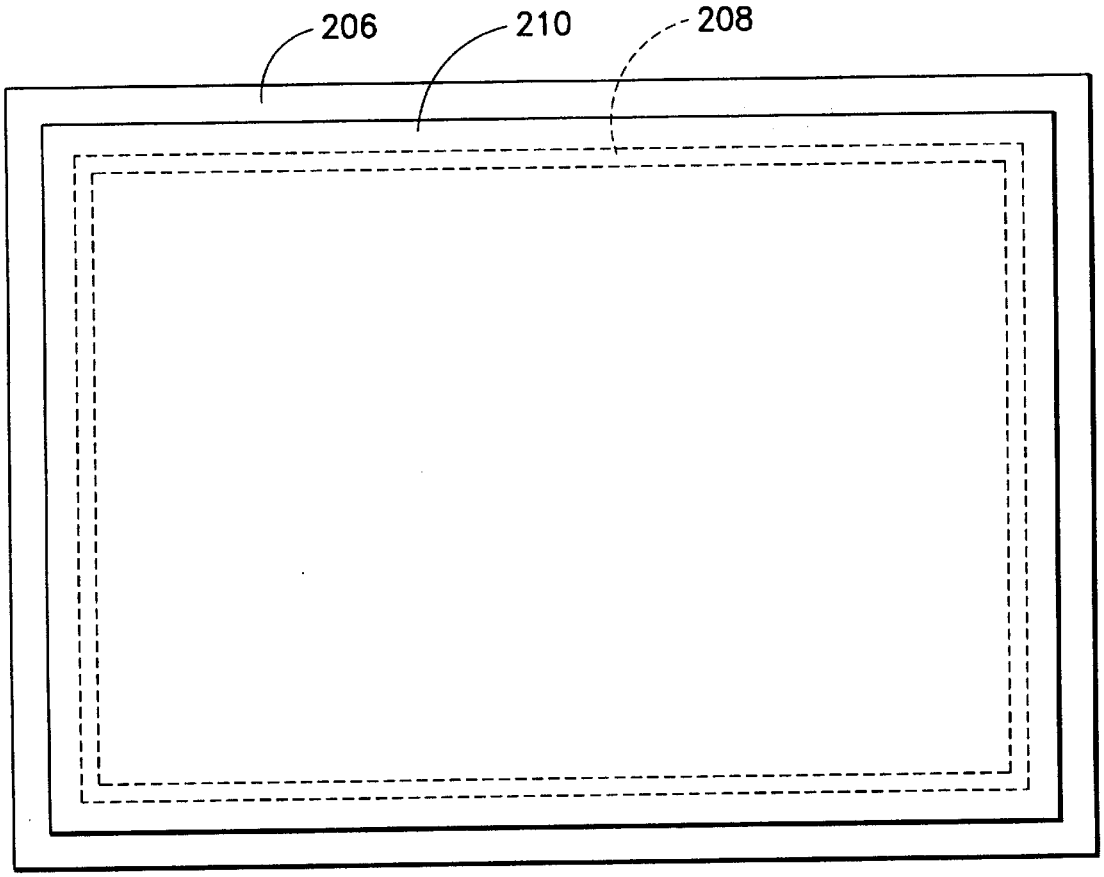
FIG. 4 shows a top view of a use resulting from the present invention.

FIG. 3 shows the apparatus of FIG. 2 used to dispense a continuous amount of admixture rather than a droplet as shown in FIG. 2. In FIG. 3, the mixing structure 200 causes a continuous line 204 of heated adhesive to be dispensed by the extruder 202 onto a substrate 206. The dispensing port 222 may be such that the width of the line of dispensed adhesive is narrow or extremely broad as required by the particular utilization. A flexible body 210 can be attached to the substrate 206 with the use of minimal pressure applied by a roller 212. This forms a bond-line 208 to adhere the flexible body 210 to the substrate 206. The resin cures in place to form a strong high temperature adhesive joint without requiring that the entire assembly be heated to cure the adhesive. A top view of a flexible body 210 adhered to a substrate 206 by a bond-line 208 is shown in FIG. 4.

Many alternative configurations of the present invention can be used according to the needs of the particular utilization. For example, it can be used to vary the volume of material dispensed from drop to drop by controlling the screw extruder. It can also be used with the admixture caused to run in a continuous mode in which the volume per unit time is changing in a controlled manner. Varying the bond thickness along a bond line could result in adherence with near optimal strength. Multiple dispense heads emanating from a common mixing chamber could be employed simultaneously. A single moving head can be used in a conveyor system. The head moves on an axis substantially perpendicular to the direction of motion of the conveyer to deliver the admixture to a number of distinct workpieces on the conveyor. Single or multiple dispense heads can be used to dispense admixture over a surface of a first substrate to which a second substrate is being adhered. The resulting single or multiple bond-lines being predetermined and controlled in accordance with a preprogrammed manner. It is noted that the cross-sectional shape of the material delivered does not have to be circular. It can be set to depend upon the shape of the final orifice. This is especially so, when the admixture is being dispensed in a continuous mode. The mixing chamber and the dispense head need not be arranged coaxially. The present invention will work just as well if the mixing chamber is separated from the dispense head as long as the stirrer is designed to direct the admixture material towards the delivery stage and wherein a means is employed to speed the chemical reaction of only a small portion of substance at the point of ejection.

A range of resin chemistries can be used which can result in an admixture which cures very rapidly. A material of choice is an aliphatic epoxy resin with a catalyst. The actual admixture cure time can vary widely depending upon the catalyst type and its concentration as shown in the examples below. For purposes of the examples, the cure temperature was standardized at 100° C. It is very well known in the art that increasing temperature will reduce the cure time.

It is generally desirable for the resin to be filled with a material which performs a number of tasks. These tasks include: eliminating light from reaching the encapsulated workpiece; protecting the encapsulated workpiece from mechanical damage; preventing absorption of excessive moisture which could corrode the package metallurgy; capturing heat energy; etc. To accomplish these tasks, the resin is usually filled with an opaque material such as carbon black which also provides some antistatic benefits. It is noted, that the viscosity of the admixture increases substantially when carbon black or another filler is added. Difficulty in mixing the resulting very viscous components can be overcome by the correct choice of mixing blades as in commonly known to those skilled in the art of chemical engineering.

A group of polymeric materials desirably employed in accordance with the present invention are cycloaliphatic epoxides.

Cycloaliphatic epoxides are known and are obtained by oxidation of cyclic olefins. Cycloaliphatic epoxy materials are generally relatively slow reacting particularly as compared to the more conventional glycidyl ether type of epoxides. Examples of suitable cycloaliphatic epoxides are suggested in U.S. Pat. Nos. 3,027,357; 2,890,194; 2,890,197; and 4,294,746, disclosures of which are incorporated herein by reference. Some specific examples of suitable cycloaliphatic epoxides are: 3,4-epoxycyclohexylmethyl-3,4-epoxycyclohexane carboxylate, available from Union Carbide under the trade designation ERL-4221; bis (3,4-epoxy-6-methylcyclohexylmethyl) adipate; bis (3,4-epoxycyclohexylmethyl) adipate; bis (2,3-epoxycyclopentyl) ether; vinyl cyclohexane diepoxide, available from Union Carbide under the trade designation ERL-4206; 2-(3,4-epoxycyclohexyl)-5,5-spiro(2,3-epoxycyclohexane)-m-dioxane; 2-(3,4-epoxycyclohexyl-5,5-spiro-3,4-epoxy) cyclohexane-m-dioxane, available from Union Carbide under the trade designation ERL-4234; and bis (3,4-epoxycyclohexyl) adipate, available from Union Carbide under the trade designation ERL-4299.

A discussion of various cycloaliphatic epoxides may be found in the publication entitled "Cycloaliphatic Epoxide Systems", Union Carbide, 1970, disclosure of which is incorporated herein by reference.

Mixtures of cycloaliphatic epoxides can be employed when desired. A preferred cycloaliphatic epoxide employed pursuant to the present invention is 3,4-epoxycyclohexylmethyl 3,4-epoxycyclohexanecarboxylate (systematic name: 7-oxabicyclo[4.1.0]heptane-3-carboxylic acid 7-oxabicyclo[4.1.0]hept-3-ylmethyl ester)

The compositions of the present invention include an anhydride of an organic carboxylic acid as a hardening agent. The hardening agent is preferably in liquid form. If a solid anhydride hardening agent is employed, such should be melted when added to the composition. Examples of anhydrides are methyltetrahydrophthalic anhydride; hexahydrophthalic anhydride; maleic anhydride, trimellitic anhydride; pyromellitic dianhydride, tetrahydrophthalic anhydride; phthalic anhydride; norbornenedicarboxylic anhydride; nadic methyl anhydride; and methylcyclohexane-1,2-dicarboxylic anhydride.

Additional anhydrides can be found, for instance, in H. Lee and K. Neville, *Handbook of Epoxy Resin*, McGraw Hill, 1967, Chapter 12, disclosure of which is incorporated herein by reference.

An anhydride curing agent is generally employed in amounts constituting on an equivalent basis, about 20% to about 120% of the cycloaliphatic epoxide employed and desirably about 75% to about 100% of the epoxide equivalents.

In addition to the cycloaliphatic epoxide and hardener, a reactive modifier can also be used. The purpose of the reactive modifier is to impart desirable mechanical properties to the cured composition such as flexibility and thermal shock resistance. Examples of modifiers which can be used are fatty acids, fatty acid anhydrides such as polyazelaic polyanhydride and dodecenylsuccinic anhydride, long chain alcohols, polyetherdiols such as polyethylene glycol and polypropylene glycol, and other materials having hydroxyl, carboxyl, epoxy, and/or carboxylic anhydride functionality.

In order to provide a composition having reaction times fast enough to be compatible in a reaction injection molding process, it is usually necessary to employ as reaction or hardener promoter an alkylene oxide substituted adduct of an imidazole. The alkylene oxide employed can be ethylene oxide, propylene oxide, or butylene oxide and is preferably propylene oxide. The imidazole employed is preferably imidazole. However, if desired, substituted imidazoles can be used, including alkyl substituted such as $C_1$–$C_{12}$ alkyl groups. When a substituted imidazole is employed as the imidazole it is usually substituted at the carbon atoms of the imidazole ring and more usually at positions 4 and/or 5 thereof. Mixtures of imidazoles as well as mixtures of alkylene oxides can be used. The adduct is usually obtained from about 0.5 to about 10 alkylene oxide units per imidazole. The propylene oxide adduct of imidazole is available from Dixie Chemical Company under the trade designation AP-5. The hydroxyl number (as determined by the method in ASTM volume 08.02, p 608, method D2849.30.1.3 (1984) is about 406.5 mg KOH/g sample or about 138.0 g/eq. AP-5 is a viscous liquid having the empirical formula of $C_6H_{10}N_2O$ (MW 126) according to the manufacturer and contains about one propylene oxide per imidazole.

The alkylene oxide adduct of imidazole is employed in amounts of about 0.1% to about 10% by weight and preferably about 1% to about 5% by weight based upon the total weight of the cycloaliphatic epoxide, anhydride hardening agent, and alkylene oxide adduct of imidazole. The alkylene oxide adduct of imidazole promotes the hardening of the cycloaliphatic epoxide and also enters into reaction and, thereby, is not free to migrate and does not promote corrosion in the cured encapsulated product.

The compositions of the present invention can also include fillers such as silicon dioxide ($SiO_2$), aluminum oxide ($Al_2O_3$), tantalum pentoxide ($Ta_2O_5$), silicon carbide (SiC), boron carbide ($B_4C$), tungsten carbide (WC), silicon nitride ($Si_3N_4$), and lithium aluminum silicate compounds. Selection of the proper filler, filler mixture ratios, and filler loading is based on the potential of the fillers to lower the coefficient of thermal expansion (CTE) of the resulting composite and can be determined by persons skilled once aware of the present disclosure without undue experimentation. The unfilled cycloaliphatic epoxy has a CTE (coefficient of thermal expansion) of 95 ppm/° C. As the filler concentration is raised, a linear decrease in CTE following the linear rule of mixtures is obtained. This is observed for all the fillers listed with $Al_2O_3$ exhibiting the largest reduction in CTE (45%) and tantalum pentoxide with the least improvement (20%) at a filler loading of 95% by weight. In these examples, the fillers were not treated with any interfacial adhesion promoters.

If fillers are employed in the composition, these are usually present in amounts of about 10% to 98% by weight, and preferably about 90% to 95% by weight.

The compositions of the present invention exhibit a viscosity of about 50 centipoise to about 5,000 centipoise at about 25° C. and more usually about 100 centipoise to about 1,000 centipoise at about 25° C., typical of which is about 700 centipoise at about 25° C.

The compositions are generally prepared by rapidly admixing immediately prior to introduction in the mold, the epoxy employed with a mixture of the anhydride and the promoter under pressure conditions of about 500 psi to about 3,000 psi and typically about 1,000 psi. In the event fillers are employed, the pressure is usually about 1,500 psi to about 2,000 psi. If a filler and/or flexibilizer is employed, such can be provided with either the epoxy or the mixture of anhydride and promoter or partially with both.

The composition is then introduced into the mold for the encapsulation. The pressure in the mold is about 25 psi to about 50 psi which is advantageous since the electronic part being encapsulated will not be exposed to the type of high pressure employed in transfer molding operations. The temperature of the mold is usually about: 100° C. to about 200° C. and more usually about 130° C. to about 160° C. The time in the mold is from about 30 seconds to about 10 minutes and more preferably about 1 minute to about 5 minutes, shorter times being employed for use at higher temperatures. The encapsulated article is removed from the mold when it is in a tack-free state. It can then be subjected to a post-cure such as heating at about 150° C. to about 200° C., typical of which is about 185° C. for about 1 hour to about 3 hours, preferably about 2 hours.

Example of typical microelectronic devices that can employ the composition of the present invention can be found in *Surface Mount Technology,* G. Caswell, Chapter 1, International Society for Hybrid Microelectronics, 1984, disclosure of which is incorporated herein by reference.

The following non-limiting examples are presented to further illustrate the present invention.

EXAMPLE 1

A composition containing about 6.0 parts by weight of 3,4-epoxycyclohexylmethyl-3,4-epoxycyclohexanecarboxylate (Union Carbide ERL-4221) and about 4.0 parts by weight of a Union Carbide ERL-4350 (a proprietary cycloaliphatic flexibilizing epoxy of Union Carbide); above 8.0 parts by weight of methylcyclohexane-1,2-dicarboxylic anhydride (about 89% of the epoxide equivalent of the cycloaliphatic epoxide) and about 0.4 parts by weight of propylene oxide adduct of imidazole (Dixie Chemical Company-AP-5).

The composition is subjected to a temperature of about 150° C. and exhibits a gel time thereat of less than 2 minutes. The gel time is the amount of time to provide a tack-free composition that can be removed from the mold.

EXAMPLE 2

A composition containing about 5.2 parts by weight of 3,4-epoxycyclohexylmethyl 3,4-cyclohexylcarboxylate, about 10.7 parts by weight of a polypropylene glycol (Union Carbide Niax LHT-34), about 5.4 parts by weight of methylcyclohexane-1,2-dicarboxylic anhydride, and about: 0.25 parts by weight of propylene glycol adduct of imidazole (Dixie Chemical Company AP-5). The composition is subjected to a temperature of 100° C. and exhibits a gel time of about 21 minutes.

EXAMPLE 3

A composition containing about 7.0 parts by weight of ERL-4221, about 3.0 parts by weight of ERL-4350, about 8.7 parts by weight of methylcyclohexane-1,2-dicarboxylic anhydride, and about 0.19 parts by weight of AP-5. The composition is subjected to a temperature of 100° C. and exhibits a gel time of about 23 minutes.

Example 3 is repeated, except that about 0.37 parts by weight of AP-5 are used. The gel time at 100° C. is about 15 minutes.

EXAMPLE 5

Example 3 is repeated, except that about 0.56 parts by weight of AP-5 is used. The gel time at 100° C. is about 8 minutes.

Comparison Example A

ERL-4221 (about 10 parts by weight), NIAX LHT-34 (about 20 parts by weight), and methylcyclohexane-1,2-dicarboxylic anhydride (about 10 parts by weight) were mixed with various levels of pyridine and subjected to 100° C. The respective gel times are shown below.

| Promoter | Parts by Weight | Gel Time (min) at 100° C. |
|---|---|---|
| None | — | >221 |
| Pyridine | 0.12 | 60 |
| Pyridine | 0.24 | 57 |
| Pyridine | 0.50 | 56 |

Comparison Example B

ERL-4221 (about 10.0 parts by weight), NIAX LHT-34 (about 15.5 parts by weight), and methylcyclohexane-1,2-dicarboxylic anhydride (about 10.4 parts by weight) were mixed with various promoters and subjected to 100° C. The respective gel times are reported below.

| Promoter | Parts by Weight | Gel Time (min) at 100° C. |
|---|---|---|
| Pyridine | 0.12 | 52 |
| 2,3-Diazabicyclooctane | 0.12 | 45 |
| 2-Ethyl-4-Methylimidazole | 0.24 | >60 |
| Benzyldimethylamine | 0.24 | >72 |
| Morpholine | 1.2 | >126 |

Comparison Example C

ERL-4221 (about 7.0 parts by weight), ERL-4350 (about 3.0 parts by weight), and methylcyclohexane-1,2-dicarboxylic anhydride (about 8.7 parts by weight) were mixed with various promoters and subjected to 100° C. The respective gel times are reported below.

| Promoter | Parts by Weight | Gel Time (min) at 100° C. |
|---|---|---|
| Pyridine | 0.19 | 20 |
| 2-Ethyl-4-Methylimidazole | 0.19 | >78 |
| Benzyldimethylamine | 0.19 | 57 |

The 100° C. used in Examples 2–5 and Comparison Examples A–C provides for a very convenient screening or testing temperature with the actual temperature more usually employed in the RIM process being about 150° C. Those compositions exhibiting gel times of about 25 minutes or less at 100° C. normally exhibit gel times of less than 2 minutes at 140° C. to 160° C. As apparent from a comparison of Comparison Examples A-C with Examples 1–5, the use of the alkylene oxide of the imidazole provides for significantly improved reaction times as compared to the various promoters tested, except for certain of the examples with pyridine. However, pyridine is not especially suitable since it is a monomeric material that remains as such in the cured polymer as a potentially troublesome free amine.

Although the invention was described for an application of workpiece encapsulation, and with the cure time of the reactants being speeded up by the use of localized heat upon dispensing, the intent and features of the invention are useful and intended to be used for other types of applications. It will be apparent to those skilled in the art that modifications to the disclosed embodiments can be effected without departing from the spirit and scope of the present invention.

What is claimed is:

1. A process for dispensing onto a plurality of workpieces a combination substance formed from a plurality of materials, said combination substance being a mixture having at least two components which react at a first rate with each other at a first temperature to convert said combination substance into a gelled material and which react with each other at a second rate at a second temperature, said second temperature being lower than said first temperature and said second rate being slower than said first rate, thereby keeping said combination substance ungelled at said second temperature for a longer time than at said first temperature, comprising the steps of:

mixing a quantity of said combination substance at said second temperature in a mixing chamber;

dispensing a portion of said mixed combination substance onto each one of said plurality of workpieces from an output port of a dispense head connected to said mixing chamber; and selectively raising the temperature only of each said portion of said combination substance being dispensed to said first temperature with a heater located at the output port just before said each portion is dispensed onto one of said workpieces.

2. A process as in claim 1 further comprising the step of preheating each of said plurality of workpieces prior to said dispensing of said combination substance.

3. A process as in claim 1 wherein said combination substance encapsulates each of said plurality of workpieces and said combination substance cures to a permanent state.

4. A process as in claim 1 wherein said plurality of workpieces are mounted on a tape reel means.

5. A process as in claim 1 wherein said first temperature is sufficiently high to convert said controlled portion into a gelled material within 10 minutes after being dispensed onto one of said workpieces.

* * * * *